US009605501B2

(12) United States Patent
Nikiforuk

(10) Patent No.: US 9,605,501 B2
(45) Date of Patent: Mar. 28, 2017

(54) SYSTEM FOR RELEASING A CEMENT PLUG

(71) Applicant: Tesco Corporation, Houston, TX (US)

(72) Inventor: Kevin James Nikiforuk, Houston, TX (US)

(73) Assignee: TESCO CORPORATION, Houston, TX (US)

( * ) Notice: Subject to any disclaimer, the term of this patent is extended or adjusted under 35 U.S.C. 154(b) by 250 days.

(21) Appl. No.: 14/594,999

(22) Filed: Jan. 12, 2015

(65) Prior Publication Data

US 2016/0201414 A1 Jul. 14, 2016

(51) Int. Cl.

| | |
|---|---|
| ***E21B 23/10*** | (2006.01) |
| ***E21B 23/00*** | (2006.01) |
| ***E21B 33/05*** | (2006.01) |
| ***E21B 33/16*** | (2006.01) |

(52) U.S. Cl.

CPC ..... *E21B 23/10* (2013.01); *E21B 23/00* (2013.01); *E21B 33/05* (2013.01); *E21B 33/16* (2013.01)

(58) Field of Classification Search

USPC ..... 166/72, 154, 155, 285

See application file for complete search history.

(56) References Cited

U.S. PATENT DOCUMENTS

| | | | | |
|---|---|---|---|---|
| 2,928,470 A * | 3/1960 | Baker | E21B 33/14 | 166/154 |
| 5,918,677 A * | 7/1999 | Head | E21B 17/00 | 166/207 |
| 6,244,350 B1 * | 6/2001 | Gudmestad | E21B 33/05 | 166/332.1 |
| 6,311,775 B1 * | 11/2001 | Allamon | A61M 25/10 | 166/153 |

(Continued)

*Primary Examiner* — Blake Michener
*Assistant Examiner* — Kenneth Beyers
(74) *Attorney, Agent, or Firm* — Fletcher Yoder, P.C.

(57) ABSTRACT

In accordance with one aspect of the disclosure a system includes a plug launching assembly, including a housing. The system also includes a first flow assembly of the plug launching assembly including a first primary flow path configured to direct a fluid flow into a wellbore. Moreover, the first flow assembly is configured to transition from a first position to a second position within the plug launching assembly. Also, the first flow assembly is releasably coupled to the housing while in the first position. The system further includes a second flow assembly of the plug launching assembly coupled to the housing and positioned downstream of the first flow assembly. The first flow assembly engages the second flow assembly while the first flow assembly is in the second position. The system also includes a cement plug releasably coupled to the second flow assembly. Furthermore, the cement plug is positioned within a second primary flow path of the second flow assembly while the cement plug is coupled to the second flow assembly. The system also includes a cement plug launcher of the second flow assem- (Continued)

bly configured to release the cement plug from a stored position, in which the cement plug is coupled to the cement plug launcher, to a release position. Also, the system includes a bypass line of the plug launching assembly configured to direct the fluid flow from the first flow assembly to the second flow assembly while the first flow assembly is in the first position.

20 Claims, 6 Drawing Sheets

(56) References Cited

U.S. PATENT DOCUMENTS

| | | | | |
|---|---|---|---|---|
| 6,401,823 | B1 * | 6/2002 | Gonzalez | E21B 21/001 166/319 |
| 2008/0190613 | A1 * | 8/2008 | Tjorswaag | E21B 17/05 166/289 |
| 2012/0312557 | A1 * | 12/2012 | King | E21B 34/103 166/386 |
| 2016/0160603 | A1 * | 6/2016 | Sevadjian | E21B 33/14 166/288 |

* cited by examiner

SYSTEM FOR RELEASING A CEMENT PLUG

BACKGROUND

Embodiments of the present disclosure relate generally to the field of drilling and processing of wells. More particularly, present embodiments relate to a system and method for launching a cement plug during casing operations.

Cement plugs are typically utilized during casing operations to substantially remove cement from an interior surface of wellbore tubulars. In conventional oil and gas operations, an annulus is formed around the wellbore tubulars and a formation. During completion operations, casing (e.g., wellbore tubulars) may be secured to the formation via cementing. The cement is pumped through the casing to fill the annulus and secure the casing to the formation. After cement pumping is complete, the cement plug is introduced into the casing to clear the cement from the interior surface of the casing. As a result, cementing operations may continue with little to no mixing of cement with the drilling/displacement fluids pumped through the casing.

BRIEF DESCRIPTION

In accordance with one aspect of the disclosure a system includes a plug launching assembly, including a housing. The system also includes a first flow assembly of the plug launching assembly including a first primary flow path configured to direct a fluid flow into a wellbore. Moreover, the first flow assembly is configured to transition from a first position to a second position within the plug launching assembly. Also, the first flow assembly is releasably coupled to the housing while in the first position. The system further includes a second flow assembly of the plug launching assembly coupled to the housing and positioned downstream of the first flow assembly. The first flow assembly engages the second flow assembly while the first flow assembly is in the second position. The system also includes a cement plug releasably coupled to the second flow assembly. Furthermore, the cement plug is positioned within a second primary flow path of the second flow assembly while the cement plug is coupled to the second flow assembly. The system also includes a cement plug launcher of the first flow assembly configured to release the cement plug from a stored position, in which the cement plug is coupled to the cement plug launcher, to a release position. Also, the system includes a bypass line of the plug launching assembly configured to direct the fluid flow from the first flow assembly to the second flow assembly while the first flow assembly is in the first position.

In accordance with another aspect of the disclosure a system includes a ball launcher configured to release a ball into a wellbore and a cement swivel positioned downstream of the ball launcher. The cement swivel is configured to direct a flow of fluid into the wellbore. The system also includes a plug launching assembly positioned downstream of and fluidly coupled to the cement swivel, a first flow assembly of the plug launching assembly, and a second flow assembly of the plug launching assembly positioned downstream of the first flow assembly. The first flow assembly of the plug launching assembly includes a cement plug launcher configured to release a cement plug into the wellbore upon activation. Moreover, the system includes a gap of the plug launching assembly positioned between the first flow assembly and the second flow assembly while the first flow assembly is in a first position. The system also includes a bypass line of the plug launching assembly extending between the gap and the second flow assembly. The bypass line is configured to direct the flow of fluid from the gap to the second flow assembly while the first flow assembly is in the first position. Furthermore, the system includes an auxiliary flow line fluidly coupled to the first flow assembly and the second flow assembly. The auxiliary flow line is configured to direct the flow of fluid from the first flow assembly to the second flow assembly while the first flow assembly is in a second position. Also, a geometry of the first flow assembly engages with a corresponding geometry of the second flow assembly such that the first flow assembly substantially fills a volume of the gap while the first flow assembly is in the second position.

In accordance with another aspect of the disclosure a system includes a first flow assembly. The first flow assembly includes a first primary flow path having a first section having a first diameter and a second section having a second diameter, the first diameter being greater than the second diameter. The first flow assembly is configured to transition from a first position to a second position. The system also includes a second flow assembly including a second primary flow path and a plurality of flow ports configured to receive a flow of fluid from upstream of the second flow assembly and bypassing at least a portion of the second primary flow path. Moreover, the first flow assembly is engaged with the second flow assembly in the second position. The system further includes a housing configured to align the first flow assembly with the second flow assembly within the housing. The first flow assembly is positioned upstream of the second flow assembly and the first flow assembly is releasably engaged with the housing in the first position.

DRAWINGS

These and other features, aspects, and advantages of the present disclosure will become better understood when the following detailed description is read with reference to the accompanying drawings in which like characters represent like parts throughout the drawings, wherein.

Figure 1:
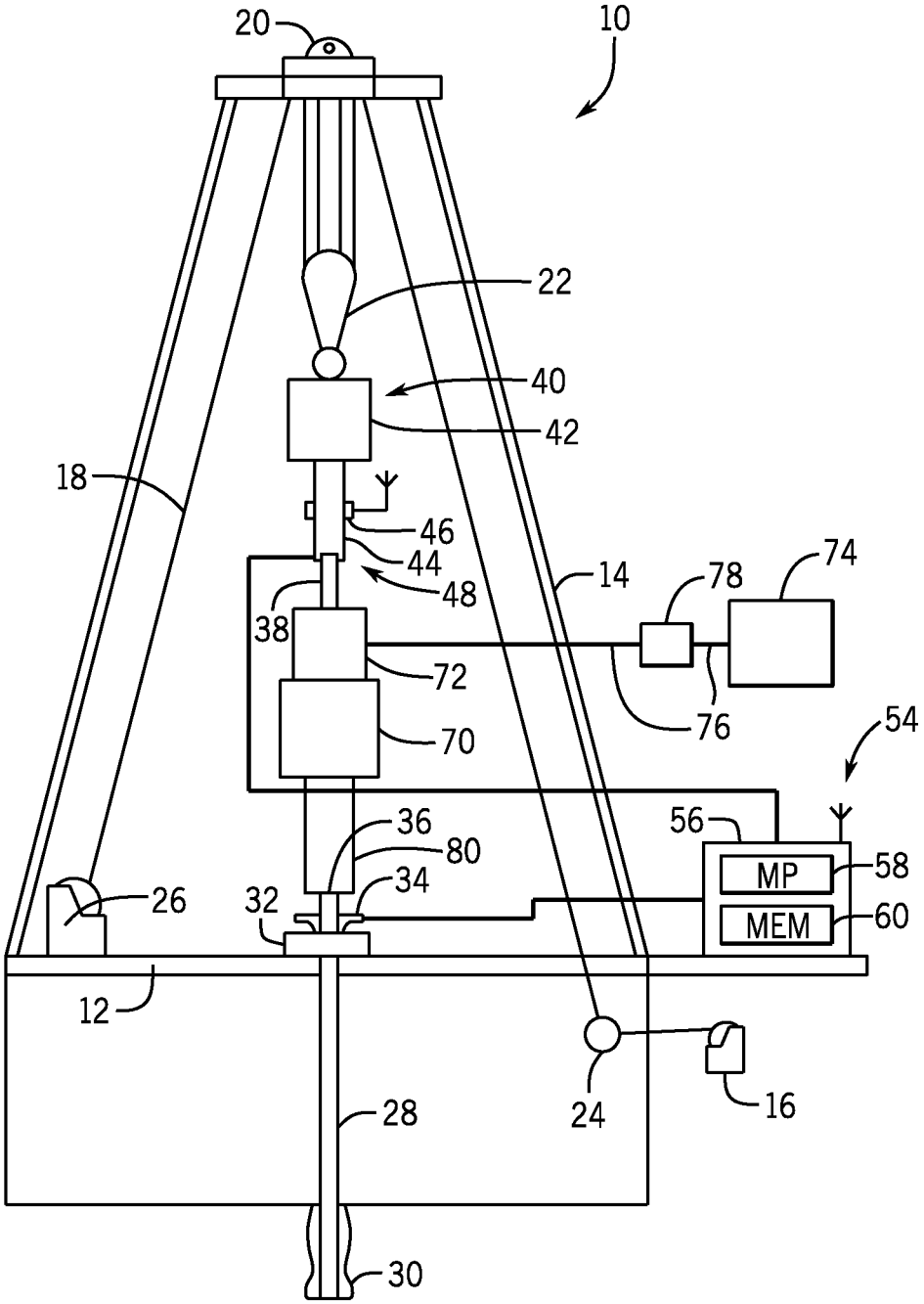
FIG. 1 is a schematic of an embodiment of a well being drilled with a plug launching assembly, in accordance with present techniques.
Figure 4:
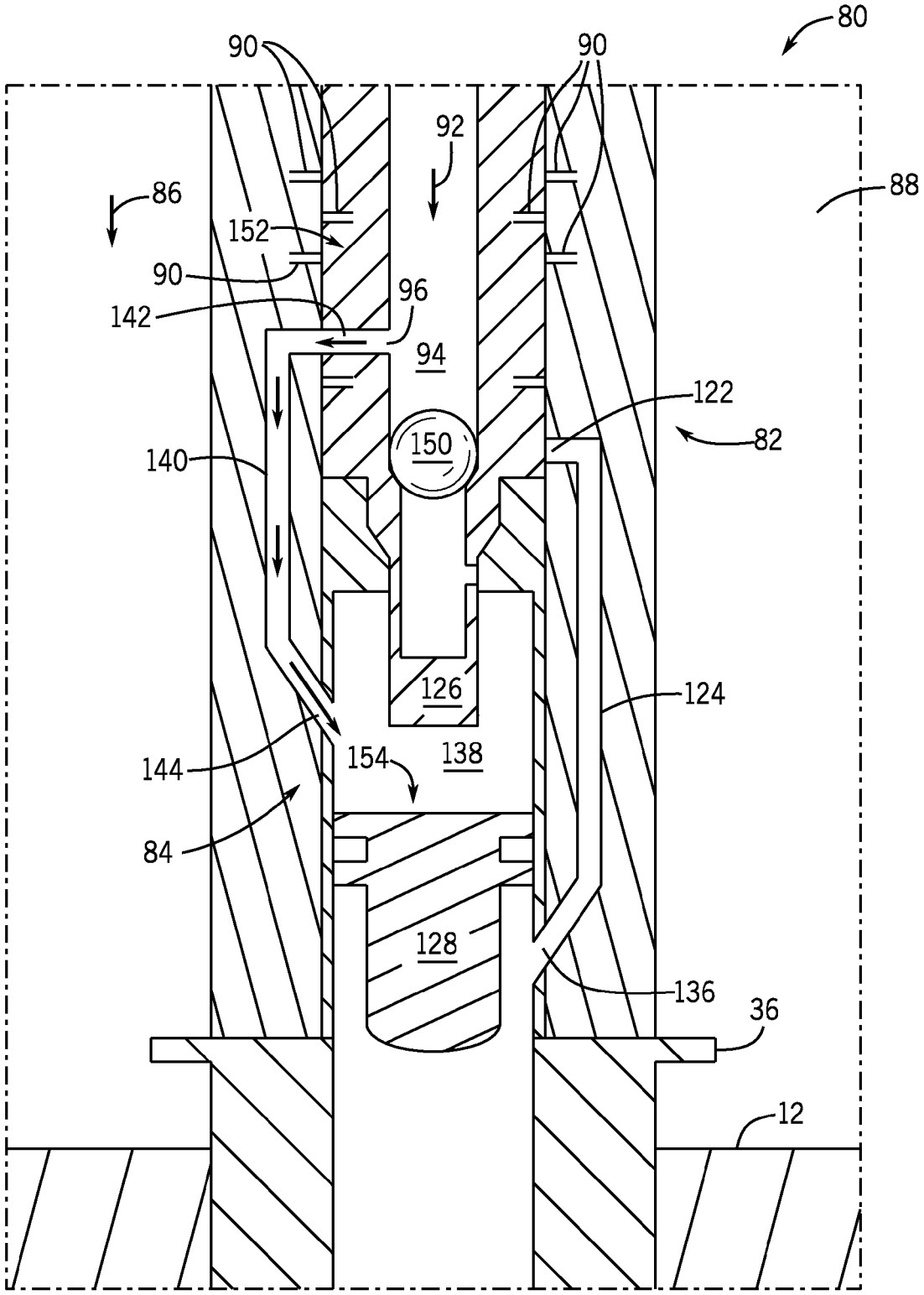
Figure 5:
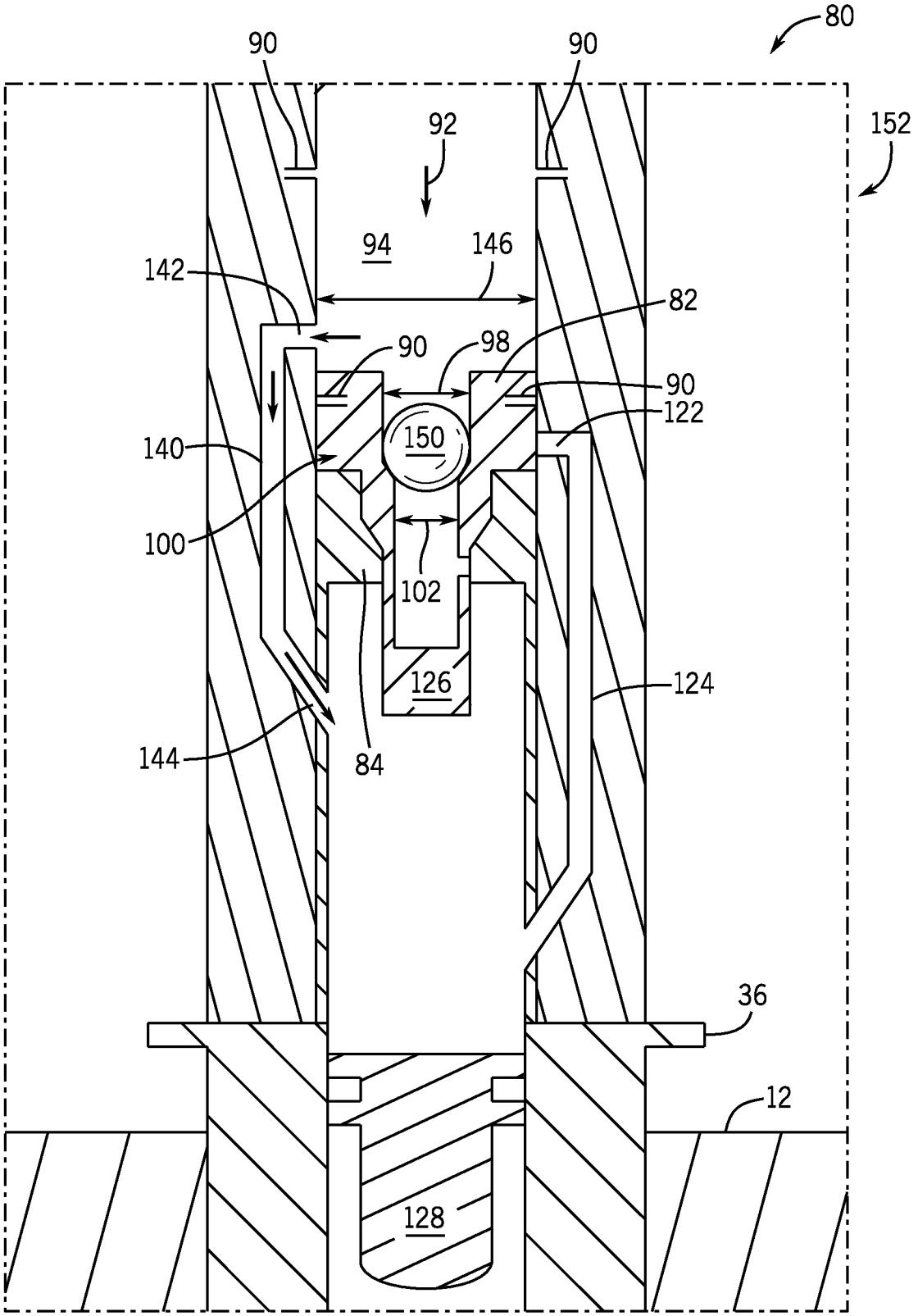
Figure 6:
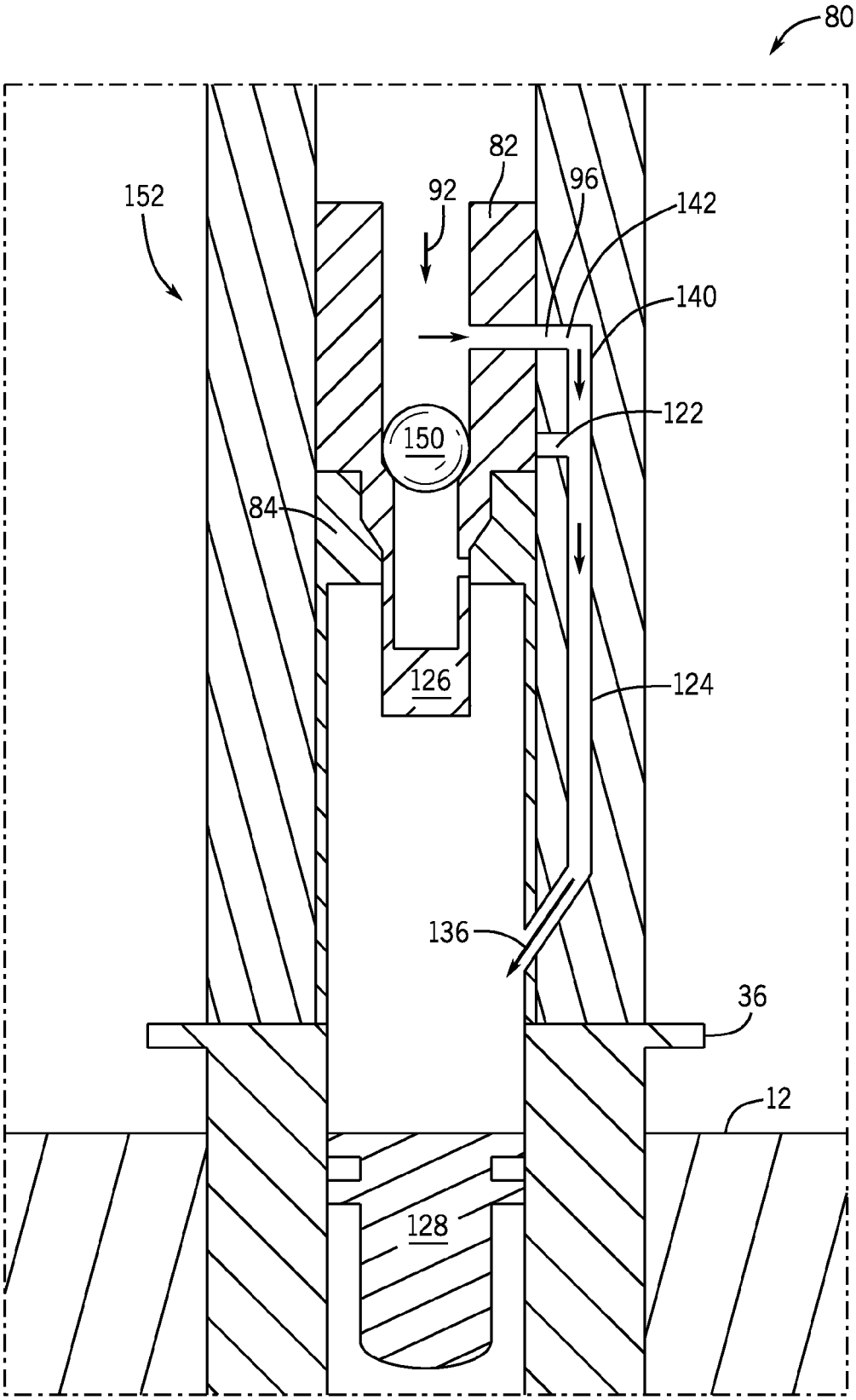

FIG. 4 is a cross-sectional view of the plug launching assembly of FIG. 1 in a second position, in accordance with present techniques; and FIG. 5 is a cross-sectional view of another embodiment of the plug launching assembly of FIG. 1 in a second position, in accordance with present techniques; and FIG. 6 is a cross-sectional view of a further embodiment of the plug launching assembly of FIG. 1 in a second position, in accordance with present techniques.

DETAILED DESCRIPTION

Present embodiments provide a cement plug launching assembly configured to provide a flow of a fluid around a plug launcher. For example, a bypass line is configured to direct the flow from a first primary flow path to a second primary flow path via flow ports disposed in a first flow assembly and a second flow assembly. Furthermore, an auxiliary flow line is configured to redirect flow around a blocked first primary flow path via flow ports disposed in the first and second flow assemblies. The plug launching assembly is configured to receive a ball to activate the plug launcher and release a cement plug disposed within the second flow assembly. In certain embodiments, the ball blocks the flow of fluid through the first primary flow path, thereby generating sufficient force to fracture shear pins and release the first flow assembly. As a result, the first flow assembly is configured to engage the second flow assembly and release the cement plug.

Turning now to the drawings, FIG. 1 is a schematic view of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a casing string 28 extends downward into a wellbore 30 and is held stationary with respect to the rig floor 12 by a rotary table 32 and slips 34 (e.g., power slips). A portion of the casing string 28 extends above the rig floor 12, forming a stump 36 to which another length of tubular 38 (e.g., a section of casing) may be added.

A tubular drive system 40, hoisted by the traveling block 22, positions the tubular 38 above the wellbore 30. In the illustrated embodiment, the tubular drive system 40 includes a top drive 42, a gripping device 44, and a tubular drive monitoring system 46 (e.g., an operating parameter monitoring system) configured to measure forces acting on the tubular drive system 40, such as torque, weight, and so forth. For example, the tubular drive monitoring system 46 may measure forces acting on the tubular drive system 40 via sensors, such as strain gauges, gyroscopes, pressure sensors, accelerometers, magnetic sensors, optical sensors, or other sensors, which may be communicatively linked or physically integrated with the system 46. The gripping device 44 of the tubular drive system 40 is engaged with a distal end 48 (e.g., box end) of the tubular 38. The tubular drive system 40, once coupled with the tubular 38, may then lower the coupled tubular 38 toward the stump 36 and rotate the tubular 38 such that it connects with the stump 36 and becomes part of the casing string 28.

The drilling rig 10 further includes a control system 54, which is configured to control the various systems and components of the drilling rig 10 that grip, lift, release, and support the tubular 38 and the casing string 28 during a casing running or tripping operation. For example, the control system 54 may control operation of the gripping device 44 and the power slips 34 based on measured feedback (e.g., from the tubular drive monitoring system 46 and other sensors) to ensure that the tubular 30 and the casing string 28 are adequately gripped and supported by the gripping device 44 and/or the power slips 34 during a casing running operation. In this manner, the control system 54 may reduce and/or eliminate incidents where lengths of tubular 38 and/or the casing string 28 are unsupported. Moreover, the control system 54 may control auxiliary equipment such as mud pumps, robotic pipe handlers, and the like.

In the illustrated embodiment, the control system 54 includes a controller 56 having one or more microprocessors 58 and a memory 60. For example, the controller 56 may be an automation controller, which may include a programmable logic controller (PLC). The memory 60 is a non-transitory (not merely a signal), tangible, computer-readable media, which may include executable instructions that may be executed by the microprocessor 56. The controller 56 receives feedback from the tubular drive monitoring system 46 and/or other sensors that detect measured feedback associated with operation of the drilling rig 10. For example, the controller 56 may receive feedback from the tubular drive system 46 and/or other sensors via wired or wireless transmission. Based on the measured feedback, the controller 56 regulates operation of the tubular drive system 46 (e.g., increasing rotation speed).

In the illustrated embodiment, the drilling rig 10 also includes a casing drive system 70. The casing drive system 70 is configured to reciprocate and/or rotate the tubular 38 (e.g., casing) during casing and/or cementing operations. In the illustrated embodiment, the casing drive system 70 is placed above the rig floor 12. However, in other embodiments the casing drive system 70 may be placed beneath the rig floor 12, at the rig floor 12, within the wellbore 30, or any other suitable location on the drilling rig 10 to enable rotation of the tubular 38 during casing and/or cementing operations. As mentioned above, in certain embodiments, the control system 54 may control the operation of the casing drive system 70. For example, the control system 54 may increase or decrease the speed of rotation of the tubulars 38 based on wellbore conditions.

The casing drive system 70 may be used during cementing operations to direct cement into the casing string 28. In the illustrated embodiment, the casing drive system 70 is coupled to a cement swivel 72 configured to supply cement for cementing operations. For example, the cement swivel 72 may receive cement from a pumping unit 74 via a supply line 76. Additionally, the casing drive system 70 may include an inner bore configured to direct the cement through the casing drive system 70 and into the casing string 28. Moreover, the illustrated embodiment includes a ball launcher 78 positioned in the supply line 76 between the cement swivel 72 and the pumping unit 74. As will be described below, the ball launcher 78 is configured to introduce a ball into the cement swivel 72 to activate a cement plug launcher positioned downstream of the casing drive system 70. However, as will be described below, in other embodiments the cement plug launcher may be integral with the casing drive system 70, integral with the casing string 28, or located near the bottom of the wellbore 30.

As shown in FIG. 1, a plug launching assembly 80 is positioned downstream of the casing drive system 70. In the illustrated embodiment, the plug launching assembly 80 is configured to receive the ball from the ball launcher 78 and to release the cement plug via the cement plug launcher, thereby enabling the cement plug to travel down the casing string 28. As will be described in detail below, the plug launching assembly 80 is configured to direct a flow of cement through a first primary flow path and around the cement plug via a bypass line. However, once the ball activates the cement plug launcher and releases the cement plug, the plug launching assembly 80 directs a flow of drilling/displacement fluid around the ball and through an auxiliary flow path. Moreover, while the plug launching assembly 80 is illustrated above the rig floor 12, in other embodiments the plug launching assembly 80 may be below the rig floor 12, integral with the casing drive system 70, integral to the casing string 28, or located near the bottom of the wellbore 30.

It should be noted that the illustration of FIG. 1 is intentionally simplified to focus on the plug launching assembly 80 of the drilling rig 10, which is described in greater detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform. While only certain features of the invention have been illustrated and described herein, many modifications and changes will occur to those skilled in the art. It is, therefore, to be understood that the appended claims are intended to cover all such modifications and changes as fall within the true spirit of the invention.

Figure 2:
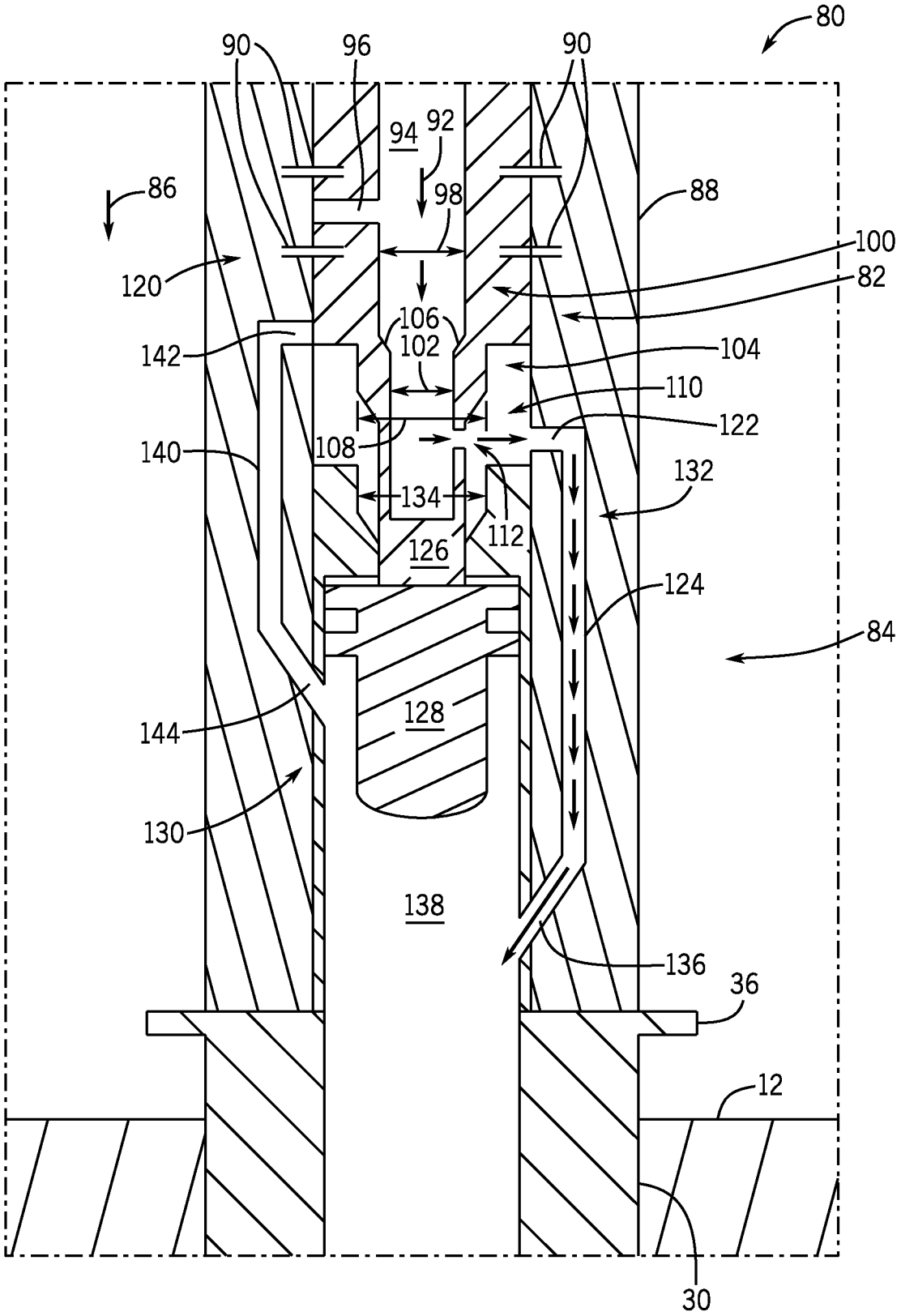
FIG. 2 is a schematic cross-sectional view of the plug launching assembly of FIG. 1 in a first position, in accordance with present techniques.

FIG. 2 is a cross-sectional side view of an embodiment of the plug launching assembly 80 positioned above the rig floor 12. However, it will be appreciated that in other embodiments the plug launching assembly 80 may be positioned at the rig floor 12, beneath the rig floor 12, or within the wellbore 30. As shown, the plug launching assembly 80 includes a first flow assembly 82 and a second flow assembly 84. In the illustrated embodiment, the first flow assembly 82 is positioned above of the second flow assembly 84, relative to a downward direction 86. As used herein, the downward direction 86 will generally refer to a direction approximately transverse or perpendicular to the rig floor 12. In other words, the first flow assembly 82 is positioned upstream of the second flow assembly 84, relative to the direction of flow of the cement and/or drilling/displacement fluids into the wellbore 30.

In the illustrated embodiment, the first and second flow assemblies 82, 84 are positioned within a housing 88. The housing 88 is configured to align the first flow assembly 82 with the second flow assembly 84. As will be described below, alignment of the first and second flow assemblies 82, 84 enables the first flow assembly 82 to activate a plug launcher disposed within the second flow assembly 84. In certain embodiments, the housing 88 enables the plug launching assembly 80 to couple to the casing drive system 70 (e.g., via threads, via flanges). Moreover, in the illustrated embodiment, the first flow assembly 82 is secured to the housing 88 via shear pins 90. The shear pins 90 are configured to support the weight of the first flow assembly 82 and a flow 92 of fluid (e.g., cement, drilling fluid) traveling through the first flow assembly 82 as represented generally by the arrows. In the illustrated embodiment, the flow 92 is substantially in the downward direction 86. However, as will be described below, upon release of the ball the shear pins 90 are configured to fracture to enable the first flow assembly 82 to move in the downward direction 86 toward the second flow assembly 84. While the illustrated embodiment depicts shear pins 90 configured to position the first flow assembly 82 above the second flow assembly 84, in other embodiments different attachment mechanisms with modes of operation (e.g., attached, detached, actuated, unactuated) may be utilized. For example, the first flow assembly 82 may be positioned on tracks or guide rails with an actuator configured to move the first flow assembly 82 in the downward direction 86.

The first flow assembly 82 includes a first primary flow path 94 configured to enable the flow 92 of fluid through the first flow assembly 82 and toward the second flow assembly 84. In the illustrated embodiment, the first primary flow path 94 is generally cylindrical and disposed substantially through the center of the first flow assembly 82. However, in other embodiments, the first primary flow path 94 may be disposed in any suitable alignment relative to the first flow assembly 82 based on the expected flow conditions. As shown, the first primary flow path 94 is fluidly coupled to a first flow port 96. In the illustrated embodiment and mode of operation, the first flow port 96 is substantially blocked by the housing 88. That is, little or no flow continues through the first flow port 96. In certain embodiments, seals are arranged around an outlet of the first flow port 96 to further block flow out of the first flow port 96 while the housing 88 is positioned proximate to the first flow port 96. As will be described below, the first flow port 96 is configured to align with a first auxiliary flow port after the first primary flow path 94 is blocked by the ball.

As described above, the first primary flow path 94 receive the flow 92 of fluid from the casing drive system 70. The first primary flow path 94 has a first diameter 98 in a first section 100 and a second diameter 102 in a second section 104. As shown, the first diameter 98 is larger than the second diameter 102. In the illustrated embodiment, the change in diameter between the first and second sections 100, 104 forms a shoulder 106 configured to receive the ball. In certain embodiments, the shoulder 106 includes seals configured to substantially block flow around the ball while the ball is positioned on the shoulder 106. Furthermore, the second section 104 of the first flow assembly 82 has an outer diameter 108 configured to align with the second flow assembly 84. As will be described below, the second section 104 of the first flow assembly 82 is configured to engage the second flow assembly 84 to release the cement plug.

In the illustrated embodiment, a gap 110 is positioned between the first flow assembly 82 and the second flow assembly 84 while the first flow assembly 82 is in a first position 120. While the first flow assembly 82 is in the first position 120, the shear pins 90 are configured to secure the first flow assembly 82 to the housing 88. However, in other embodiments (e.g., in embodiments using an actuator instead of shear pins), the first position 120 may be referred to as the position in which the first flow assembly 82 is not engaged with the second flow assembly 84. In the illustrated embodiment, the gap 110 is configured to enable movement of the first flow assembly 82 in the downward direction 86. In certain embodiments, the distance between the first and second flow assemblies 82, 84 (and, thereby, the height of the gap 110) may be 1 inch, 2 inches, 4 inches, 6 inches, 8 inches, 10 inches, 12 inches, or any suitable distance depending on the design conditions of the drilling rig 10. For example, in certain embodiments, the gap 110 may be as small as possible to minimize the size and weight of the plug launching assembly 80.

Furthermore, as described above, the gap 110 is configured to receive the flow 92 of the fluid as the fluid passes through the first flow assembly 82 (e.g., via an outlet 112). As a result, the gap 110 is sized to enable the flow 92 of the fluid through the first flow assembly 82 and toward a first bypass port 122. In certain embodiments, the first bypass port 122 is formed in the housing 88. However, in other embodiments, the first bypass port 122 may extend out of the housing 88 or be disposed in an annulus formed between the first and second flow assemblies 82, 84 and the housing 88. The first bypass port 122 is fluidly coupled to a bypass line 124 configured to direct flow from the gap 110 to the second flow assembly 84. In the illustrated embodiment, the bypass line 124 is formed in the housing 88. However, in other embodiments the bypass line 124 may extend out of the housing 88. For example, the bypass line 124 may be flexible tubing coupling the first bypass port 122 to the second flow assembly 84. As will be described below, the bypass line 124 is configured to direct the flow 92 around the cement plug 128 and into a second primary flow path 138 of the second flow assembly 84.

In the illustrated embodiment, the first flow assembly 82 includes a cement plug launcher 126. The cement plug launcher 126 is configured to release a cement plug 128 from a stored position 130 (e.g., coupled to the second flow assembly 84) to a released position. In certain embodiments, the cement plug launcher 126 may include a piston that extends to drive the cement plug 128 down the casing string 28. However, in other embodiments, the cement plug launcher 126 may include shear pins that break to release the cement plug 128 or any other suitable system to release the cement plug 128. For example, the cement plug launcher 126 may be coupled to the control system 54 and the release of the cement plug 128 may be controlled by activation of a sensor. As shown, a third section 132 of the second flow assembly 84 is configured to receive the first flow assembly 82 when the first flow assembly 82 is released from the first position 120. That is, an inner diameter 134 of the third section 132 is approximately equal to the outer diameter 108 of the second section 104. As a result, the second section 104 of the first flow assembly 84 is configured to engage the third section 132 of the second flow assembly 84 to release the cement plug 128.

As described above, the bypass line 124 is configured to provide the flow 92 of the fluid around the cement plug launcher 126 from the gap 110 to the second flow assembly 84. In the illustrated embodiment, a second bypass port 136 fluidly couples the bypass line 124 to a second primary flow path 138 of the second flow assembly 84. As shown, the second bypass port 136 is positioned downstream of the cement plug 128, thereby enabling the flow 92 to enter the second primary flow path 138 while the cement plug 128 is in the stored position 130.

While the bypass line 124 is configured to fluidly couple the gap 110 and the second flow assembly 84, an auxiliary flow line 140 is configured to fluidly couple the first flow assembly 82 and the second flow assembly 84. The auxiliary flow line 140 is configured to fluidly couple to the first flow port 96 of the first flow assembly 82 while the first flow assembly 82 is in the second position. That is, the first flow port 96 aligns with a first auxiliary flow port 142 when the first flow assembly 82 activates the cement plug launcher 126. Additionally, a second auxiliary flow port 144 couples the auxiliary flow line 140 to the second primary flow path 138 of the second flow assembly 84. As shown, the auxiliary flow line 140 is disposed within the housing 88. However, in other embodiments, the auxiliary flow line 140 may extend out of the housing 88 or be disposed in an annulus formed between the first and second flow assemblies 82, 84 and the housing 88. For example, the auxiliary flow line may be flexible tubing or another suitable tubular configured to transfer the flow 92 from the first flow assembly 82 to the second flow assembly 84. In the illustrated embodiment, the second auxiliary flow port 144 is positioned downstream of the cement plug 128. However, in other embodiments, the second auxiliary flow port 144 may be positioned upstream of the cement plug 128.

As described above, during casing and/or drilling operations the flow 92 of the fluid may be directed through the first primary flow path 94 into the gap 110. The flow 92 is blocked from exiting the first flow port 96 due to the placement of the housing 88 blocking the outlet of the first flow port 96. Moreover, in certain embodiments, seals are placed about the first flow port 96 to further block or reduce the flow from the first flow port 96 while the first flow assembly 82 is in the first position 120. The flow 92 of the fluid exits the gap 110 via the first bypass 122 and enters the bypass line 124. The bypass line 124 directs the flow 92 of the fluid around the cement plug 128 and into the second primary flow path 138 of the second flow assembly 84 via the second bypass port 136. As a result, drilling, casing, and/or cementing operations may continue while the cement plug 128 is in the stored position 130.

Figure 3:
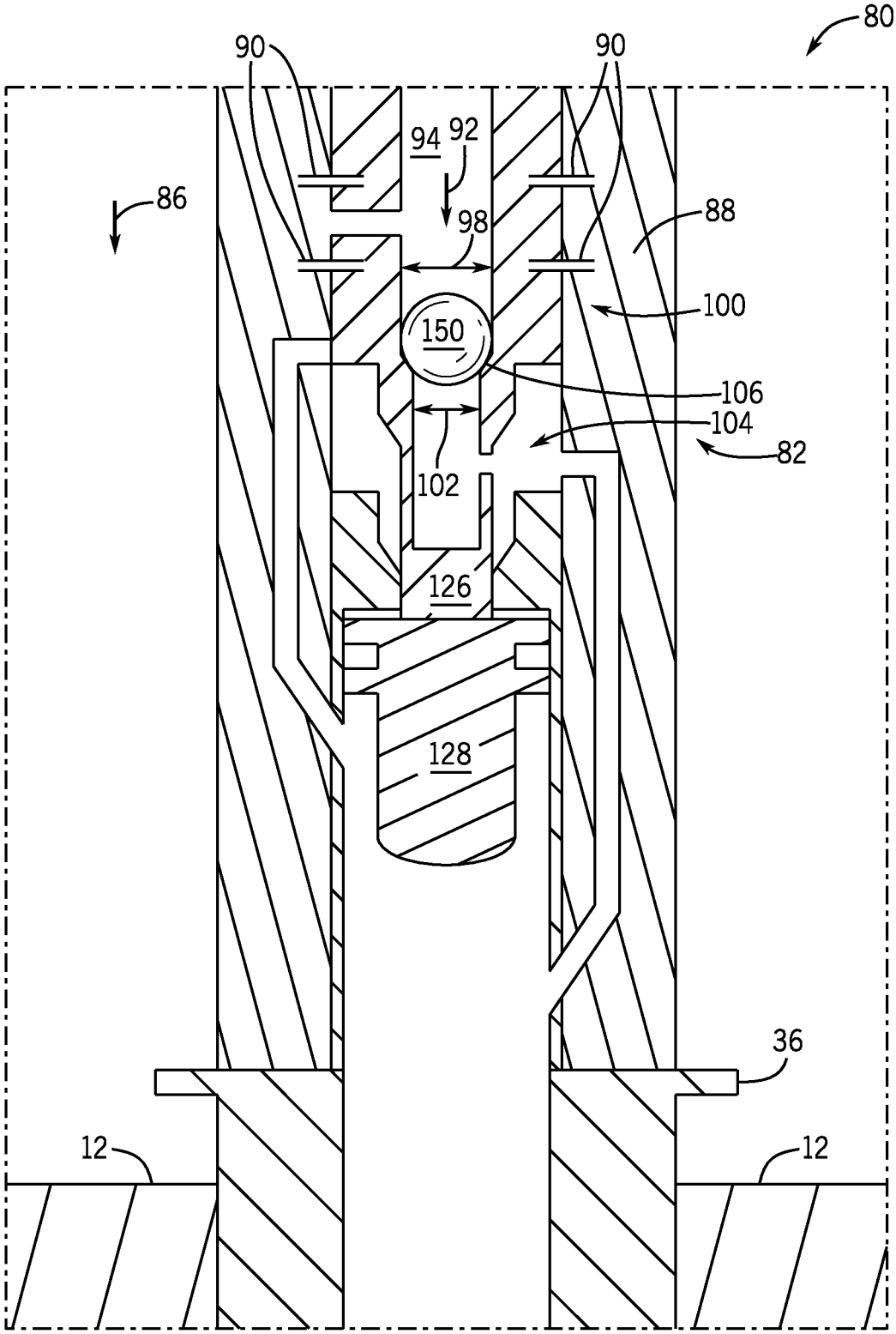
FIG. 3 is a cross-sectional view of the plug launching assembly of FIG. 1 with a ball disposed in a first primary flow path, in accordance with present techniques.

FIG. 3 is a cross-sectional view of an embodiment of the plug launching assembly 80 with a ball 150 positioned in the first primary flow path 94 of the first flow assembly 82. As mentioned above, the ball 150 is configured to enter the first primary flow path 94 via the ball launcher 78 positioned in the supply line 76 upstream of the cement swivel 72. During the casing and/or cementing operation, an operator may release the ball 150 into the supply line 76 to travel through the cement swivel 72 and casing drive system 70 into the plug launching assembly 80. In the illustrated embodiment, a diameter of the ball 150 is smaller than the first diameter 98 of the first section 100 of the first flow assembly, enabling the ball 150 to flow through the first primary flow path 94. However, the shoulder 106 is configured to block the ball 150 from entering the second section 104 of the first flow assembly 82. Moreover, in certain embodiments, seals may be positioned on the shoulder 106 to further block the flow of cement, drilling fluid, or the like through the first primary flow path 94. Accordingly, the flow 92 of the fluid will encounter a blockage at the shoulder 106 due to the ball 150. As a result, the flow 92 to the gap 110 is blocked, therefore blocking the flow 92 through the bypass line 124 and into the second flow assembly 84.

The blockage in the first primary flow path 94 is configured to generate a downward force in the first flow assembly 82. For example, the pressure of the fluid blocked in the first flow assembly 82 generates a force on the shear pins 90. Furthermore, in certain embodiments, the flow 92 may continue toward the first flow assembly 82, even with the blockage in place. As a result, as mentioned above, the shear pins 90 are configured to fracture. In certain embodiments, the shear pins 90 may be designed to resist a predetermined amount of pressure or hold for a predetermined amount of time after the ball 150 blocks the first primary flow path 94. For example, the shear pins 90 may be designed and calibrated to fracture one minute after the ball 150 reaches the shoulder 106. As will be described in detail below, the first flow assembly 82 is configured to move in the downward direction 86 after the shear pins 90 break to engage the second flow assembly 84.

FIG. 4 is a cross-sectional view of the first flow assembly 82 in a second position 152 and the cement plug 128 in a released position 154. As mentioned above, the blockage in the first primary flow path 94 creates a pressure build up in the first flow assembly 82, thereby enabling the shear pins 90 to break and release the first flow assembly 82 from the housing 88. Accordingly, the first flow assembly 82 moves in the downward direction 86 and engages the second flow assembly 84. As mentioned above, the second section 104 of the first flow assembly 82 is shaped such that the second section 104 and the third section 132 of the second flow assembly 84 align while the first flow assembly is in the second position 152. As a result, the cement plug launcher 126 is activated (e.g., driven toward the cement plug 128), and the cement plug 128 is released and travels through the second primary flow path 138. In the illustrated embodiment, the cement plug 128 is configured to travel to the end of the casing string 28 and to remove the cement from the inner surface of the casing string 28. Moreover, in certain embodiments, the cement plug 128 may be configured to drive cement from the casing string 28 into the annulus surrounding the casing string 28.

In the illustrated embodiment, the movement of the first flow assembly 82 into the second position 152 enables the flow 92 of the fluid through the auxiliary flow line 140. As shown, the first auxiliary flow port 142 is aligned with the first flow port 96, thereby enabling the flow 92 through the auxiliary flow line 140 from the first primary flow path 94. Accordingly, the flow 92 of the fluid is configured to travel through the auxiliary flow line 140 and enter the second primary flow path 138 via the second auxiliary flow port 144. In certain embodiments, the flow 92 drives the cement plug 128 through the casing string 28. As a result, drilling, cementing, and/or completion operations may continue without removing the casing string 28 from the wellbore 30.

Moreover, as shown in FIG. 4, the bypass line 124 is substantially blocked by the first flow assembly 82 while the first flow assembly 82 is in the second position 152. As mentioned above, the first flow assembly 82 is configured to engage the second flow assembly 84 when the shear pins 90 break. As a result, the first flow assembly 82 moves in the downward direction 86 and substantially fills the gap 110. Because the gap 110 is filled by the first flow assembly 82, the first bypass port 122 is blocked. In certain embodiments, seals are disposed about the first bypass port 122 to limit or block flow through the bypass line 124. Accordingly, the flow 92 from the casing drive system 70 is directed toward the auxiliary flow line 140.

FIG. 5 is a cross-sectional view of an embodiment of the first flow assembly 82 in the second position 152. As shown, the first flow assembly 82 engages the second flow assembly 84 to release the cement plug 128. In the illustrated embodiment, the flow 92 is directed toward the first auxiliary flow port 142 via the first primary flow path 94 without the use of the first flow port 96. For example, the first primary flow path 94 may include a third diameter 146 upstream of the first section 100 that enables the first auxiliary flow port 142 to directly couple to the first primary flow path 94. Accordingly, the flow 92 enters the auxiliary flow line 140 and is directed to the second flow assembly 84.

FIG. 6 is a cross-sectional view of another embodiment of the first flow assembly 82 in the second position 152. In the illustrated embodiment, the bypass line 124 and the auxiliary flow line 140 share a portion of the flow path configured to direct the flow 92 to the second flow assembly 84. For example, the first auxiliary flow port 142 may be positioned vertically offset from the first bypass port 122. Moreover, the auxiliary flow line 140 may be fluidly coupled to the bypass line 124, thereby forming a portion of the bypass line 124. As a result, while the first flow assembly 82 is in the second position 152, the first bypass port 122 is blocked by the first flow assembly 82. Furthermore, the first auxiliary flow port 142 is fluidly coupled to the first primary flow path 94 (e.g., via the first flow port 96). As a result, the fluid 92 may flow through the auxiliary line 140 and through the bypass line 124 to the second flow assembly 84.

As described in detail above, the plug launching assembly 80 is configured to launch the cement plug 128 during casing operations via the ball launcher 78. The ball launcher 78 is configured to introduce the ball 150 into the supply line 76 supplying cement and/or drilling fluid to the cement swivel 72. The cement swivel 72 directs the flow 92 to the casing drive system 70, which directs the flow to the plug launching assembly 80. While the first flow assembly 82 is in the first position, the flow 92 of the fluid is configured to flow through the first flow assembly 82 and through the bypass line 124, thereby bypassing the cement plug 128 positioned downstream of the first flow assembly 82. However, once the ball 150 is introduced, the ball 150 is configured to block the flow 92 through the first primary flow path 94 of the first flow assembly 82. Due to the blockage, the shear pins 90 are configured to fracture, thereby enabling the first flow assembly 82 to move in the downward direction 86 and engage the second flow assembly 84. As a result, the cement plug launcher 126 is configured to release the cement plug 128. Moreover, once the first flow assembly 82 engages the second flow assembly 84 and is positioned in the second position 152, the first flow port 96 of the first flow assembly 82 is aligned with the first auxiliary flow port 142. As a result, the flow 92 through the first primary flow path 94 is re-directed through the auxiliary flow line 140 and around blockage formed by the ball 150. Accordingly, drilling fluid can bypass the ball 150 and, via the auxiliary flow line 140, flow through the second primary flow path 138 of the second flow assembly 84.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system, comprising:

a plug launching assembly comprising a housing;

a first flow assembly of the plug launching assembly comprising a first primary flow path configured to direct a fluid flow into a wellbore, wherein the first flow assembly is configured to transition from a first position to a second position within the plug launching assembly and wherein the first flow assembly is releasably coupled to the housing while in the first position;

a second flow assembly of the plug launching assembly coupled to the housing and positioned downstream of the first flow assembly, wherein the first flow assembly engages the second flow assembly while the first flow assembly is in the second position;

a cement plug releasably coupled to the second flow assembly, wherein the cement plug is positioned within a second primary flow path of the second flow assembly while the cement plug is coupled to the second flow assembly;

a cement plug launcher of the first flow assembly configured to release the cement plug from a stored position, in which the cement plug is coupled to the cement plug launcher, to a release position; and a bypass line of the plug launching assembly configured to direct the fluid flow from the first flow assembly to the second flow assembly while the first flow assembly is in the first position.

2. The system of claim 1, comprising a gap positioned between and separating the first and second flow assemblies while the first flow assembly is in the first position, wherein the bypass line extends between the gap and the second flow assembly.

3. The system of claim 2, comprising a first bypass port fluidly coupled to the gap and a second bypass port fluidly coupled to the second flow assembly, wherein the bypass line extends between the first and second bypass ports such that the fluid flow is directed from the gap to the second flow assembly while the first flow assembly is in the first position.

4. The system of claim 1, comprising an auxiliary flow line configured to direct the fluid flow from the first flow assembly to the second flow assembly while the first flow assembly is in the second position, wherein a geometry of the first flow assembly is configured to engage with a corresponding geometry of the second flow assembly while in the second position.

5. The system of claim 4, comprising:

a first flow port fluidly coupled to the first primary flow path, wherein an outlet of the first flow port is blocked by the housing while the first flow assembly is in the first position;

a first auxiliary flow port configured to fluidly couple to the first flow port while the first flow assembly is in the second position, wherein the first auxiliary flow port is blocked by a body of the first flow assembly while the first flow assembly is in the first position; and a second auxiliary flow port fluidly coupled to the second flow assembly, wherein the auxiliary flow line extends between the first and second auxiliary flow ports.

6. The system of claim 1, wherein the first primary flow path comprises a first section having a first diameter and a second section having a second diameter, wherein the first section is upstream of the second section and the first diameter is greater than the second diameter.

7. The system of claim 6, comprising a shoulder formed at a transition between the first section and the second section, wherein the shoulder is configured to block a ball introduced into the first primary flow path such that the fluid flow through the first primary flow path is substantially blocked while the first flow assembly is in the first position.

8. The system of claim 6, wherein an outer diameter of the second section of the first flow assembly substantially corresponds to an inner diameter of a third section of the second flow assembly, and wherein the second section of the first flow assembly engages the third section of the second flow assembly while the first flow assembly is in the second position and releases the cement plug.

9. The system of claim 1, wherein the first flow assembly is coupled to the housing via shear pins while in the first position.

10. A system, comprising:

a ball launcher configured to release a ball into a wellbore;

a cement swivel positioned downstream of the ball launcher, wherein the cement swivel is configured to direct a flow of fluid into the wellbore; and a plug launching assembly positioned downstream of and fluidly coupled to the cement swivel;

a first flow assembly of the plug launching assembly comprising a cement plug launcher configured to release a cement plug into the wellbore upon activation;

a second flow assembly of the plug launching assembly positioned downstream of the first flow assembly and;

a gap of the plug launching assembly positioned between the first flow assembly and the second flow assembly while the first flow assembly is in a first position;

a bypass line of the plug launching assembly extending between the gap and the second flow assembly, wherein the bypass line is configured to direct the flow of fluid from the gap to the second flow assembly while the first flow assembly is in the first position; and an auxiliary flow line fluidly coupled to the first flow assembly and the second flow assembly, wherein the auxiliary flow line is configured to direct the flow of fluid from the first flow assembly to the second flow assembly while the first flow assembly is in a second position, wherein a geometry of the first flow assembly engages with a corresponding geometry of the second flow assembly such that the first flow assembly substantially fills a volume of the gap while the first flow assembly is in the second position.

11. The system of claim 10, comprising a housing of the plug launching assembly configured to align the first and second flow assemblies, wherein the first flow assembly is releasably coupled to the housing via shear pins while the first flow assembly is in the first position.

12. The system of claim 10, wherein a body of the first flow assembly is configured to block the bypass line while the first flow assembly is in the second position.

13. The system of claim 10, wherein a body of the first flow assembly is configured to block the auxiliary flow line while the first flow assembly is in the first position.

14. The system of claim 10, wherein the first flow assembly comprises a first flow port configured to direct the flow to the auxiliary flow line while the first flow assembly is in the second position.

15. The system of claim 10, comprising a shoulder disposed within a first primary flow path of the first flow assembly, wherein the shoulder is configured to block the ball from entering the gap while the first flow assembly is in the first position and to facilitate a transition of the first flow assembly from the first position to the second position.

16. A system, comprising:

a first flow assembly comprising a first primary flow path having a first section having a first diameter and a second section having a second diameter, the first diameter being greater than the second diameter, wherein the first flow assembly is configured to transition from a first position to a second position;

a second flow assembly comprising a second primary flow path and a plurality of flow ports configured to receive a flow of fluid from upstream of the second flow assembly and bypassing at least a portion of the second primary flow path, wherein the first flow assembly is engaged with the second flow assembly in the second position; and a housing configured to align the first flow assembly with the second flow assembly within the housing, wherein the first flow assembly is positioned upstream of the second flow assembly and the first flow assembly is releasably engaged with the housing in the first position.

17. The system of claim 16, wherein the first flow assembly comprises a first flow port configured to direct the flow of fluid from the first primary flow path to the second primary flow path via an auxiliary line while the first flow assembly is in the second position in which a geometry of the first flow assembly is configured to engage a corresponding geometry of the second flow assembly and a primary entry to the second primary flow path from the first primary flow path is substantially blocked.

18. The system of claim 16, comprising a bypass flow line configured to direct the flow of fluid from the first flow assembly to the second flow assembly while the first flow assembly is in a first position in which the first flow assembly is releasably coupled to the housing and displaced from the second flow assembly, wherein an inlet of the bypass line is positioned between the first flow assembly and the second flow assembly.

19. The system of claim 16, wherein at least one flow port of the plurality of flow ports of the second flow assembly is fluidly coupled to a bypass line configured to direct the flow of fluid to the second primary flow path while the first flow assembly is in a first position in which an auxiliary flow line is blocked by a body of the first flow assembly, and at least one flow port of the plurality of flow ports is fluidly coupled to an auxiliary flow line configured to direct the flow of fluid to the second primary flow path while the first flow assembly is in a second position in which the bypass flow line is blocked by the body of the first flow assembly.

20. The system of claim 16, comprising a shoulder formed at a transition between the first diameter and the second diameter of the first primary flow path, wherein the shoulder is configured to block a ball flowing through the first primary flow path.

* * * * *